United States Patent [19]

Aoki et al.

[11] Patent Number: 4,551,002

[45] Date of Patent: Nov. 5, 1985

[54] DEVELOPER DENSITY DETECTING APPARATUS

[75] Inventors: Matsuyuki Aoki; Shuji Tanaka, both of Ebina, Japan

[73] Assignee: Fuji Xerox Co., Ltd., Tokyo, Japan

[21] Appl. No.: 616,354

[22] Filed: Jun. 1, 1984

[30] Foreign Application Priority Data

Oct. 4, 1983 [JP] Japan ..... 58-184382

[51] Int. Cl.[4] ..... G03G 15/06

[52] U.S. Cl. ..... 355/3 DD; 355/14 D; 118/691

[58] Field of Search ..... 355/3 DD, 14 D, 3 R; 118/691, 685, 689, 690, 656–658

[56] References Cited

U.S. PATENT DOCUMENTS 4,371,257 2/1983 Nishikawa ..... 355/14 D
4,389,972 6/1983 Hirakura et al. ..... 118/691
4,419,960 12/1983 Okamura et al. ..... 118/691 X
4,451,135 5/1984 Okamura ..... 118/691 X

FOREIGN PATENT DOCUMENTS 0161940 12/1979 Japan ..... 355/14 D

*Primary Examiner*—R. L. Moses
*Attorney, Agent, or Firm*—Armstrong, Nikaido, Marmelstein & Kubovcik

[57] ABSTRACT

A developer density detecting apparatus in a copying machine including a detector roll assembly rotatably supported adjacent to a developing roll. The detector roll assembly comprises a sleeve and a plurality of magnets attached to the inner peripheral surface of the sleeve. The magnets are arranged to have different polarity alternately and terminates in the same polarity at both peripheral ends. A conductive glass is provided for receiving toners from the detector roll assembly. Mounted on the conductive glass is a photoelectrical detector for detecting developer density from the toners adhered to the conductive glass.

3 Claims, 4 Drawing Figures

DEVELOPER DENSITY DETECTING APPARATUS

BACKGROUND OF THE INVENTION

This invention relates to a developer density detecting apparatus for use with a copying machine.

A prior art device for detecting developer density includes a slanted plate mounted adjacent to a developing roll such as a magnetic brush roll for receiving scraped off developers from the developing roll and carrying them downwardly towards a detector roll assembly which comprises a sleeve and a semi-circular magnet attached to the inner periphery of the sleeve. The developers are attracted onto the sleeve by the action of the magnet and contact with a conductive glass as the sleeve rotates to thereby transfer toners onto the conductive glass. The conductive glass has mounted thereon a light emitting device and a light receiving device which in cooperation photoelectrically detect toner density adhered to the conductive glass. Since developer density is proportional to toner density, developer density can be detected by detecting toner density.

This kind of developer density detecting apparatus is disadvantageous in that developers scraped off by a pile height regulating plate tend to adhere to an outer peripheral portion of the sleeve where no magnet exists by the magnetic force of both ends of the simi-circular magnet when regulating pile height with the developers adhered to the sleeve to a constant height with the pile height regulating plate. Further, magnetic flux density decreases as the thickness of the sleeve increases. Therefore, amount of developers adhered to the sleeve decreases where opposite polarities face each other. As a result, thickness of the adhered developers becomes irregular resulting in an uneven application of toners onto the conductive glass.

SUMMARY OF THE INVENTION

It is therefore an object of the present invention to provide a developer density detecting apparatus which overcomes the above noted problems of the prior art. Another object of the present invention is to provide a developer density detecting apparatus which effectively prevents developers from adhereing to a sleeve section having no magnet mounted thereto.

A further object of the present invention is to provide a developer density detecting apparatus which enables developers to adhere uniformly onto the sleeve by increasing magnetic flux density of endmost magnets.

In accordance with an aspect of the present invention, there is provided an apparatus for detecting developer density in a copying machine employing a developing roll, comprising: a plate for receiving scraped off developer from said developing roll; a detector roll assembly rotatably supported adjacent to said developing roll and above said plate, said detector roll assembly comprising a sleeve and a plurality of transversly extending magnets attached to the inner peripheral surface of said sleeve, said magnets being arranged to have different polarity alternately and terminating in the same polarity at both peripheral ends, magnets positioned at both peripheral ends having a greater magnetic flux density than that of other magnets; a conductive glass for receiving toners from said detector roll assembly; and means for photoelectrically detecting developer density from the toners adhered to said conductive glass.

The above and other objects, features and advantages of the present invention will be readily apparent from the following description taken in conjunction with the accompanying drawings.

DESCRIPTION OF THE PREFERRED EMBODIMENT

Figure 1:
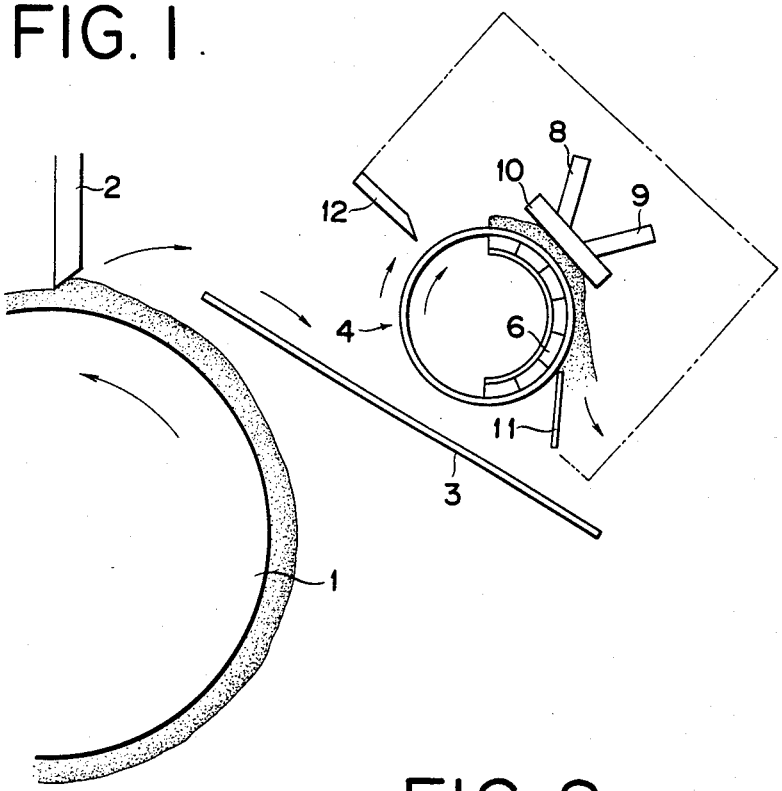
FIG. 1 is a schematic representation of a developer density detecting according to the present invention.

A preferred embodiment of the present invention will be explained in detail below with reference to the accompanying drawings. Referring first to FIG. 1, reference numeral 1 denotes a developing roll such as a magnetic roll rotatably supported within a developer housing (not shown) of a copying machine. Part of developers adhered to the developing roll 1 are scraped off by a trimming plate 2 to obtain a uniform pile height of the developers and the scraped off developers are carried by gravity on a slanted plate 3 towards a detecting roll assembly 4.

Figure 2:
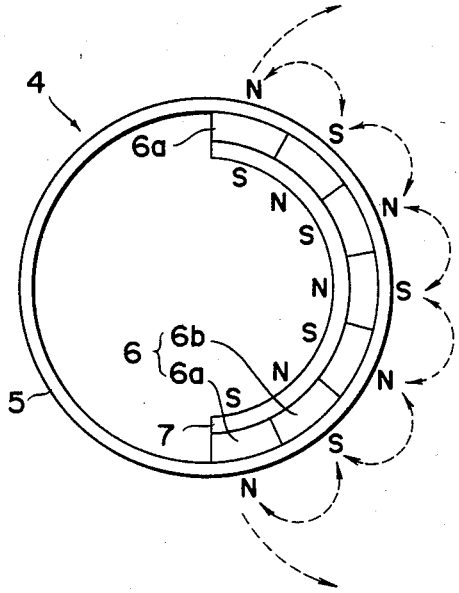
FIG. 2 is an enlarged side elevation of a detecting roll assembly employing a plurality of magnets mounted to a sleeve.

The detecting roll assembly 4 comprises, as shown in FIG. 2, a sleeve 5 and a semi-circular segmented magnet unit 6 mounted to the inner periphery of the sleeve 5. Endmost magnets *6a* have same polarity to each other, for example N polarity in the drawing at the outer peripheral side and a plurality of magnets *6b* having S and N polarities are alternately arranged between these endmost magnets *6a*. In the illustrated example, the magnet unit 6 is segmented into seven magnets. It should be noted that the magnet unit 6 must be segmented into odd number magnets to have the same polarity at both peripheral ends. The endmost magnets *6a* have 2 to 3 times greater magnetic flux density than that of other intermediate magnets *6b*. Further, a ferromagnetic plate 7 such as an iron plate is mounted to the inner periphery of the magnet unit 6 thereby increasing magnetic flux density of the magnet unit 6 by 30 to 40 percent.

Mounted obliquely above the detecting roll assembly 4 is a conductive glass 10 having a light emitting device 8 and a light recieving device 9 mounted thereto.

Toners are transferred onto the conductive glass 10 as the detector roll assembly 4 rotates and toners density adhered to the conductive glass 10 is thus photoelectrically detected. By detecting toner density, developer density can be obtained as well since developer density is proportional to toner density. Developers on the sleeve 5 which pass through the conductive glass 10 are scraped off by a scraper 11 as the detector roll assembly 4 rotates and are retrieved in the developer housing not shown.

According to the present invention, since the magnet unit 6 mounted to the inner periphery of the sleeve 5 is constructed to have same polarity at both peripheral ends magnets 6a and magnetic flux density of the endmost magnets 6a is made greater than that of the other magnets 6b, a repulsion magnetic field is created along the outer periphery of the sleeve 5 between both the endmost magnets 6a. Therefore, it is possible to prevent developers from adhereing to the outer periphery of the sleeve 5 where no magnet unit 6 exists. Further, since magnetic flux density of the magnet unit 6 is increased by mounting the ferromagnetic plate 7 to the innner periphery of the magnet unit 6, a strong enough magnetic flux density can be obtained even if thickness of the sleeve 5 does decrease magnetic flux density.

Figure 3A:
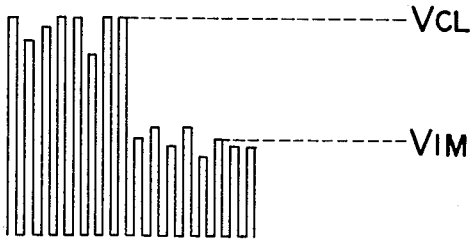
FIG. 3A PRIOR ART
FIG. 3 is a diagram showing detection signals of a prior art device wherein $V_{CL}$ represents detection signals when an electric field is applied from a conductive glass towards the detecting roll assembly and $V_{IM}$ denotes detection signals when the electric is applied reversely.
FIG. 3B similar to FIG. 3A but showing detection signals obtained according to the present invention.
Figure 3B:
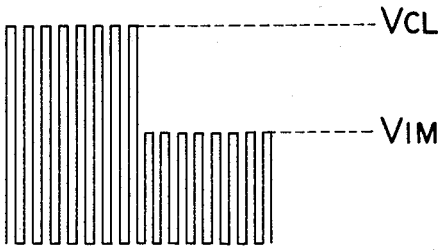

Accordingly, enough quantity of developers can be adhered to the outer periphery of the sleeve 5 and therefore an even amount of toners can be constantly supplied to the conductive glass 10 by regulating pile height of the developers with a pile height regulator 12. As a result, as shown in FIG. 3B constant peak values of developer density signals can be obtained in contrast to a prior art device in which peak values of the signals are not uniform as shown in FIG. 3A. Therefore, according to the present invention, it is possible to effect an accurate density detection regardless of any portions of the signals to be used.

In FIGS. 3A and 3B, $V_{CL}$ represents detection signals when an electric field is applied from the conductive glass 10 towards the detecting roll assembly 4. Under this condition, since toners are not adhered to the conductive glass 10, light beam from the light emitting device 8 passes through the conductive glass 10 and reflected by the sleeve 5 before it is detected by the light receiving device 9. In contrast thereto, $V_{IM}$ denotes detection signals when an electric field is reversely applied under which the light receiving device 9 detects toners adhered onto the conductive glass 10. In other words, since toners are deposited on the conductive glass 10, light passing therethrough and reflected by the sleeve 5 where no magnet exists is significantly reduced. Thus a detection value D is given as $D=V_{IM}/V_{CL}$.

Although the invention has been described and shown with particular reference to the preferred embodiment, it will be apparent that variations might be possible that would fall within the scope of the present invention which is not intended to be limited except as defined in the following claims.

What is claimed is:

1. An apparatus for detecting developer density in a copying machine employing a developing roll, comprising:

a plate for receiving scraped off developer from said developing roll;

a detector roll assembly rotatably supported adjacent to said developing roll and above said plate, said detector roll assembly comprising a sleeve and a plurality of transversely extending magnets attached to the inner peripheral surface of said sleeve, said magnets being arranged to have different polarity alternately and terminating in the same polarity at both peripheral ends, magnets positioned at both peripheral ends having a greater magnetic flux density than that of other magnets;

a conductive glass for receiving toners from said detector roll assembly; and means for photoelectrically detecting developer density from the toners adhered to said conductive glass.

2. An apparatus for detecting developer density as recited in claim 1, further comprising a ferromagnetic plate mounted to the inner peripheral surfaces of said magnets.

3. An apparatus for detecting developer density as recited in claim 2 wherein said means comprises a light emitting device and a light receiving device.

* * * * *